United States Patent [19]

von Beckmann et al.

[11] 4,132,314

[45] Jan. 2, 1979

[54] ELECTRONIC SIZE AND COLOR SORTER

[75] Inventors: Joerg W. von Beckmann, 3206 W. 6th Ave., Vancouver, British Columbia, Canada; Norman R. Bulley, Delta, Canada

[73] Assignee: Joerg Walter von Beckmann, Vancouver, Canada

[21] Appl. No.: 806,069

[22] Filed: Jun. 13, 1977

[51] Int. Cl.[2] ..... B07C 5/10; B07C 5/342

[52] U.S. Cl. ..... 209/565; 209/558; 209/586; 209/582; 250/560; 356/73; 356/398; 356/407; 356/425

[58] Field of Search ..... 209/73, 74 R, 74 M, 209/75, 111.6, 111.7 R, 111.7 T, 82; 250/226, 227, 560; 356/73, 167, 178

[56] References Cited

U.S. PATENT DOCUMENTS

| | | | |
|---|---|---|---|
| 3,750,883 | 8/1973 | Irving et al. | 209/111.6 |
| 3,781,554 | 12/1973 | Krivoshiev et al. | 209/111.6 X |
| 4,011,950 | 3/1977 | McLoughlin et al. | 209/82 X |
| 4,057,146 | 11/1977 | Castaneda et al. | 209/75 |

*Primary Examiner*—Joseph J. Rolla
*Attorney, Agent, or Firm*—Wenderoth, Lind & Ponack

[57] ABSTRACT

Disclosed is apparatus for sorting objects, e.g. tomatoes, according to both size and color. A preferred embodiment can sort the objects into fourteen size/color categories and yet requires only two photodetectors. The objects travel on a conveyor belt past a sensing station having a light source to illuminate an object and a pair of phototransistors for receiving light reflected from the object in two different color bands, e.g. red and green. The phototransistors produce a pair of output electrical signals. An analog divider forms a ratio of the electrical signals and the peak value is stored and compared with preset limits to produce a color category signal. A size category signal is derived on the basis of the time duration of the signal produced by the summation of the phototransistors' signals. The size and color category signals are decoded to produce a size/color category signal which is fed through a shift register in synchronism with the speed of the conveyor belt to actuate an associated ejection mechanism.

16 Claims, 4 Drawing Figures

ELECTRONIC SIZE AND COLOR SORTER

BACKGROUND OF THE INVENTION

This invention relates to apparatus for sorting objects according to both size and colour. While the apparatus was designed primarily for sorting fruit, and in particular tomatoes, it could be used for sorting other objects of varying size and colour.

A number of sorters based on optical principles are known in the prior art but none appear to offer the capability of sorting into a large number (e.g. fourteen) of size/colour categories while using only two photosensors as in the present invention. For example U.S. Pat. No. 3,097,774 of J. F. Hutter et al., issued July 16, 1963, discloses apparatus for sorting ore fragments according to reflectance characteristics of the ore but it apparently only makes a binary sort. That is, a particle is either accepted or rejected.

U.S. Pat. No. 3,380,460 of F. Fuis, Jr., et al., issued Apr. 30, 1968, discloses apparatus for sorting tobacco leaves and sheet metal. A relatively large number of photocells are required to measure the length of a leaf.

U.S. Pat. No. 3,382,975 of M. C. Hoover, issued May 14, 1968, relates to apparatus for sorting potatoes. Colour is not measured. A comparison is made as to whether the object is lighter or darker than a standard.

U.S. Pat. No. 3,854,586 of Perkins, III, issued Dec. 17, 1974 discloses a complicated system for sorting objects such as tobacco leaves on the basis of colour only, no measurement of size being made.

SUMMARY OF THE INVENTION

An object of the invention is to provide an apparatus for automatically sorting objects into a plurality of size/colour categories.

According to the broadest aspect of the invention there is provided apparatus for sorting objects according to size and colour comprising a conveying means having an overall reflectance in a pair of optical frequency bands less than any of the objects being sorted, sensing means comprising means to illuminate objects on said conveying means, means to receive reflected light from said object, and means to transmit portions of said reflected light to interference filters for isolation of optical signals in said pair of optical frequency bands, colour discriminating means having a means for detecting and converting said signals to electrical signals, means for amplifying said electrical signals, means for determining the ratio of said electrical signals, means for comparing said ratio with preset values to produce a signal representative of a particular colour category, size discriminating means having a voltage integrating means adapted to integrate a voltge proportional to the speed of the conveying means while the object is being sensed, means for comparing said integrated voltage with preset values to produce a signal representative of a particular size category, means for decoding said size and colour category signals to produce a resultant signal representative of a size and colour category, shift register means for storing said resultant signal and advancing said stored signal in accordance with the movement of the conveyor means, and ejection means controlled by said shift register means and adapted to eject said object according to the size and colour category.

A preferred embodiment of the present invention is able to sort objects, e.g. tomatoes, into fourteen size/colour categories and yet only requires two photosensing devices. Both colour and size information is derived from the two photosensing devices.

The apparatus according to the invention is designed to automatically sort objects into four categories based on colour. As tomatoes and other vegetable and fruit crops ripen, they change colour. This observable colour change can be equated with fruit ripeness. The invention was specifically designed to sort objects of varying colour such as tomatoes but the principle is also applicable to the sorting of objects of different colours.

During the sorting and packaging of tomatoes for the fresh market, it has been found desirable to group tomatoes of approximately the same size and ripeness into the same carton. This greatly simplifies storage and later retail display procedures.

The percentage of light that is reflected from the surface of tomatoes as the tomatoes changed from green to red was determined at each wavelength for the visible part of the electromagnetic spectrum. The amount of light reflected at 660 nm (red) increases and the amount of light reflected at 550 nm (green) decreases as the tomato ripens. The ratio of the amount of light reflected at 660 nm to that reflected at 550 nm correlates positively with the visual evaluation of the ripeness of the fruit. Based on this information, the sorting device of the invention was designed and constructed for sorting tomatoes into four colour categories (green light orange, orange, red) and five size categories (cull, small, medium, large and extra large).

Obviously the invention is not limited to 660 nm and 550 nm for the colour sorting of objects. Any two wavelengths can be used to sort into several different categories depending on the object being sorted. Also, for sorting tomatoes, 600 nm and 660 nm could be used for sorting into four colour categories. The terms "green," "light-orange," "orange" and "red" are arbitrary and other colour categories may be used if desired.

The objects to be sorted are conveyed on a belt, or a plurality of belts, in single file with random spacing between the objects. Each of the objects passes beneath a sensing head, where it is illuminated and the reflected light is received by a trifurcated fiber optic assembly. The object is categorized into a size/colour category and an appropriate signal is stored in a shift register memory associated with that size/colour category. Each shift register is synchronized with the movement of the conveyor belt, so that the stored signal is shifted at the same rate as the object travels downstream from the sensing head.

Eject stations from each size/colour category are located at fixed distances downstream from the sensing head. Each eject station is comprised of an electromechanical ejection mechanism which, when activated, moves one object off the belt into a bin or onto a cross conveyor. Each eject station has a shift register memory associated with it, of memory length equivalent to the lineal distance downstream from the sensing head that the eject station is located. When the categorized object and its appropriate eject station are in juxtaposition, the register output signal triggers the electromechanical ejection mechanism which moves the object off the conveyor. Ejection of an object is independent of belt speed and thus independent of time.

Colour sorting of the objects is based on obtaining a ratio of reflectances at two narrow bands in the visible spectrum, while size sorting of the objects is based on a length or diameter measurement. In one particular embodiment of this invention, four different categories of colour and five different categories of size comprise twenty combinations of size and colour, or twenty size/colour categories. For simplification and convenience, one category will include all sizes below a set colour limit, and a further category will include all colours below a set size limit. Thus, the total number of size/colour categories of this particular embodiment of the invention is fourteen. However, the number of size/colour categories may be increased or decreased according to individual requirements.

This may be seen from the following table.

| | COLOUR | | | |
|---|---|---|---|---|
| SIZE | RED | ORANGE | LT. ORANGE | GREEN |
| X-LARGE | 1 | 2 | 3 | 13 |
| LARGE | 4 | 5 | 6 | 13 |
| MEDIUM | 7 | 8 | 9 | 13 |
| SMALL | 10 | 11 | 12 | 13 |
| CULL | 14 | 14 | 14 | 14 |

Thus there is an eject station for each size-colour category although "culls" are ejected by simply being allowed to roll off the end of the conveyor.

BRIEF DESCRIPTION OF THE DRAWINGS

Referring to FIG. 1, a trifurcated fibre optic assembly 10 is used to illuminate objects on a conveyor belt and to receive light reflected therefrom. Light from a light source passes through N/3 fibres 11 and exits at 12 to illuminate an object. Reflected light enters end face 12 and half is conveyed by N/3 fibres 13 and half by N/3 fibres 14 to interference filters to be described later in connection with FIG. 2. Of course, if desired, any other suitable means may be used for illuminating the objects and receiving light reflected from them and the fibres need not be divided into thirds, this merely being convenient. A quartz iodine lamp can, for example, be used as the illuminator.

The conveyor belt must have an overall reflectance in the specified optical frequency bands less than any of the objects being sorted, as the conveyor belt acts as a constant background or zero reference. Furthermore, the reflectance ratio of the conveyor belt must be less than any of the objects being sorted.

Figure 2:
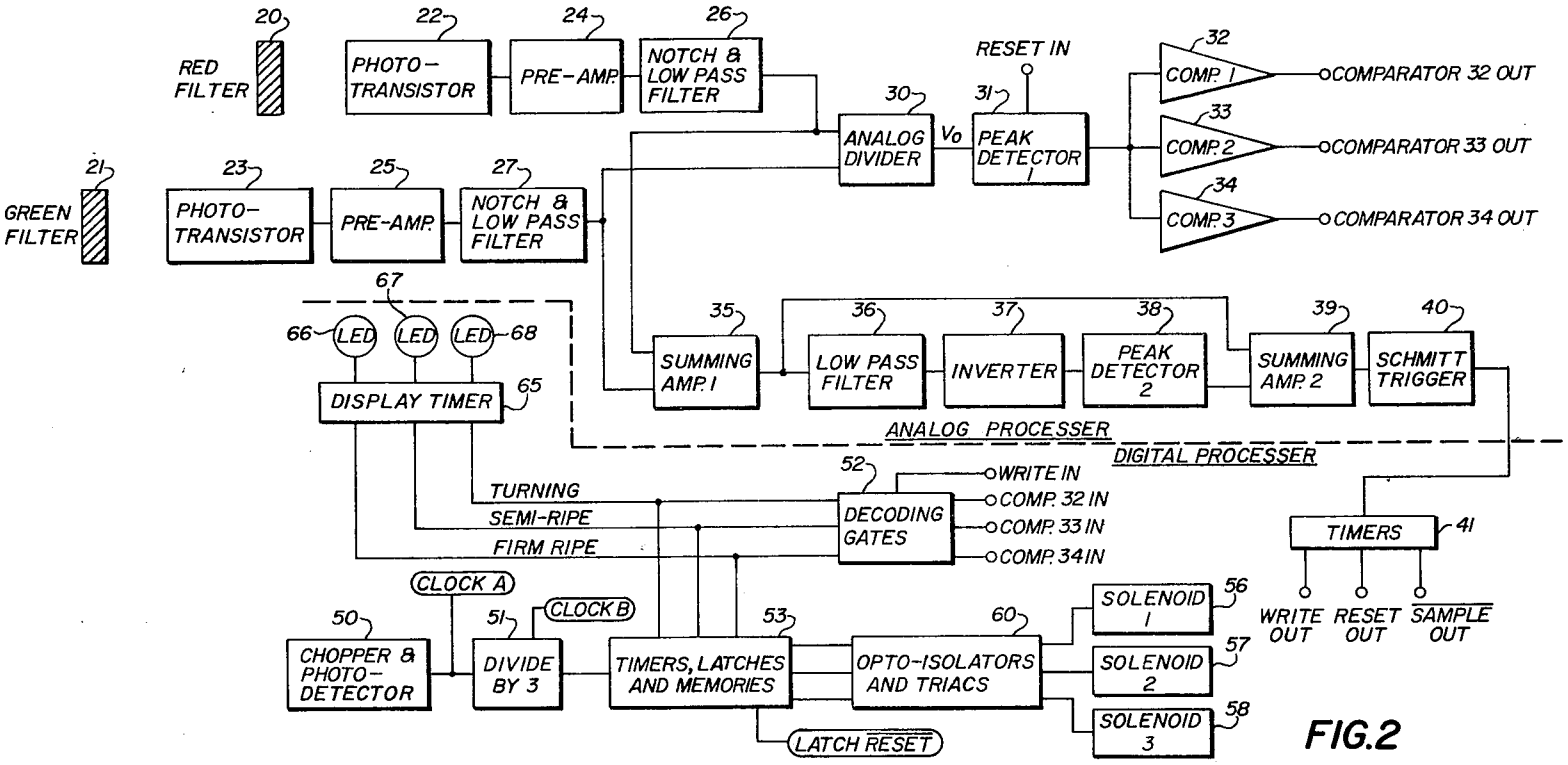
FIG. 2 is a block diagram of a colour sorter according to the invention.

Referring to FIG. 2, a colour sorter (grader) useful in the present invention is seen to comprise an analog processor portion and a digital processor portion. Most of the analog signal processor is comprised of operational amplifiers, while the digital signal processing is accomplished through the use of low power CMOS (Complementary Symmetry Metal Oxide Semiconductor) devices. The ejection mechanisms comprise pneumatic solenoid valves operating on a standard 110 volt supply to provide a burst of air in order to move the objects off the conveyor.

Figure 1:
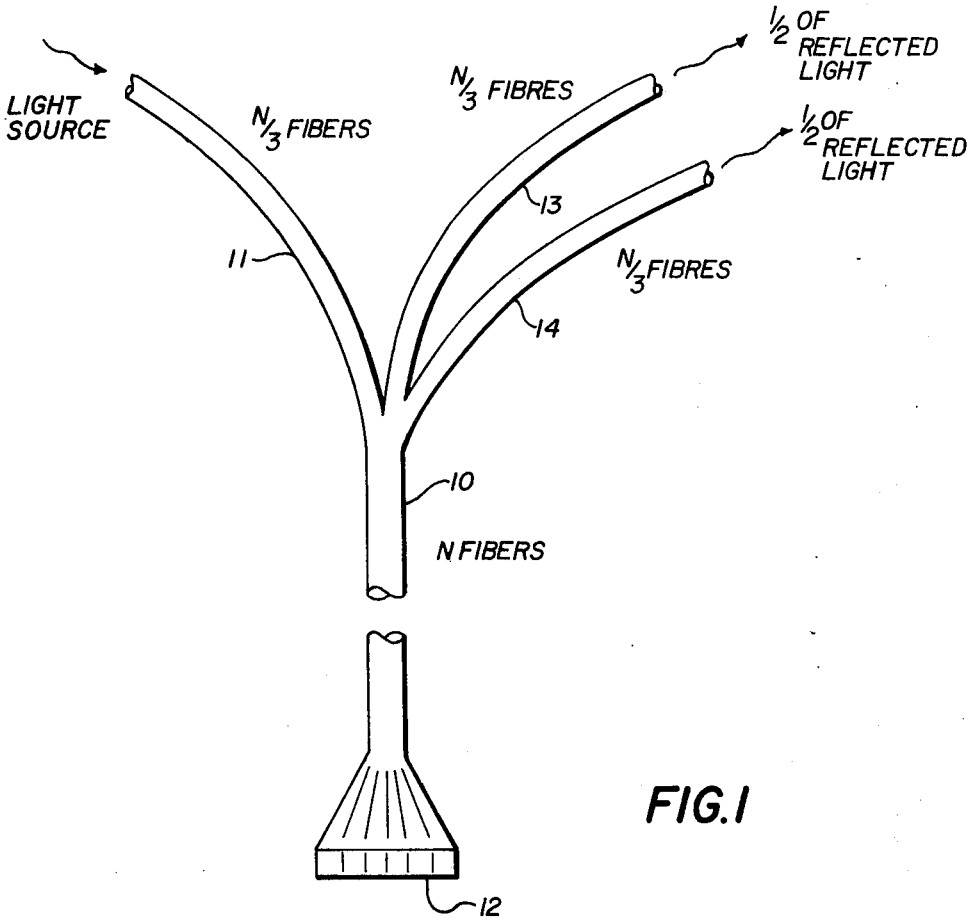
FIG. 1 is a plan view of a trifurcated fibre optic assembly used in the sorting apparatus according to the invention.
Figure 1A:
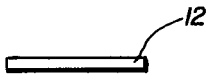
FIG. 1*a* is an end view of the composite fibre optic assembly.

Light from the fibre optics 13 and 14 (FIG. 1) passes through interference filters 20 and 21, respectively. In the example under discussion we are concerned with tomatoes so the filters 20 and 21 are red and green filters, respectively. The pass band of the red filter is centered at 650 nm and the green at 550 nm.

The reflected light transmitted through the interference filters 20 and 21 is detected by two photo transistors 22 and 23. The signals produced by phototransistors 22 and 23 are amplified by operational amplifiers 24 and 25 so that the voltage ratio of $V_{green}/V_{red}$ falls in the range of 0 to 1.25. Each photo transistor signal is passed through a filter circuit 26, 27 to eliminate the 120 Hz illuminator noise, and high frequency noise above 24 Hz.

An analog divider 30 divides the two photo transistor signals to produce an output, $V_O$, such that:

$$V_O = 12.5 - 10 \times (V_{green}/V_{red})$$

When only the conveyor is being viewed, $V_O$ is adjusted to 0. When a tomato is sensed, $V_{green}$ is always less than 1.25 times $V_{red}$. As the tomato passes beneath the sensing head, $V_O$ follows a bell-shaped curve, the peak of which is stored by a peak detector 31. The stored voltage is compared to preset limits separating adjacent colour categories by three comparators 32, 33, 34, which combined produce a digital code representative of one of four colour categories. It should be noted that the choice of "12.5" in the above formula is not a critical value. Nor is it critical that $V_{green}$ is always less than 1.25 times $V_{red}$. In the present example, the value "12.5" happens to be the saturation voltage of the op-amp when operated on a 15V supply. Any other operating voltage such as 9V could be selected in which case the value "12.5" would change to some lower value, perhaps about 6. $V_{green}/V_{red}$ would then be chosen as 0.6.

The detection of the presence of a tomato to be categorized is accomplished by the summation of the two photo detector signals by the summing amplifier 35. The output signal of the summing amplifier 35 is relatively independent of colour variations in the tomato, but the signal is sensitive to small reflectance variations in the conveyor belt. A background drift compensation circuit comprised of a low pass filter 36, an inverter 37, a peak detector 38, and a summing amplifier 39 provides signal stabilization. The output of summing amplifier 39 is the same signal as that of summing amplifier 35, but with drift compensation. The output of summing amplifier 39 is shaped into a digital signal by a Schmitt trigger circuit 40. This Schmitt trigger pulse is shaped by a digital inverter in the timer circuit 41, and is referred to as the $\overline{\text{SAMPLE}}$ signal.

A light chopper 50 mounted on the axle of one of the conveyor belt pulleys provides a clock signal whose frequency is directly proportional to conveyor speed. For the sorting of objects such as tomatoes, the period of the clock signal, CLOCK A, is chosen as 0.5 inches of conveyor travel. A second clock signal, CLOCK B, whose period is 1.5 inches of conveyor travel is also provided. A divider 51 divides CLOCK A by 3 to produce CLOCK B.

At the trailing edge of the $\overline{\text{SAMPLE}}$ pulse, the outputs of comparators 32, 33 and 34 of the colour sorter are decoded by gates 52 and the colour category signals stored by an R/S latch 53.

For simple colour sorting, the signals from gates 52 are stored in shift registers in block 53 and shifted by CLOCK B in synchronism with movement of the belt. When the object is adjacent the appropriate ejection mechanism, the last stage of the shift register actuates a solenoid 56, 57 or 58 via one of three opto-isolators and triacs 60.

The display timer circit 65 does not contribute directly to the sorting operation. The circuit drives three light emitting diodes 66, 67, 68 to indicate on the sorter front panel which of the three colour categories the object was categorized into.

Figure 3:
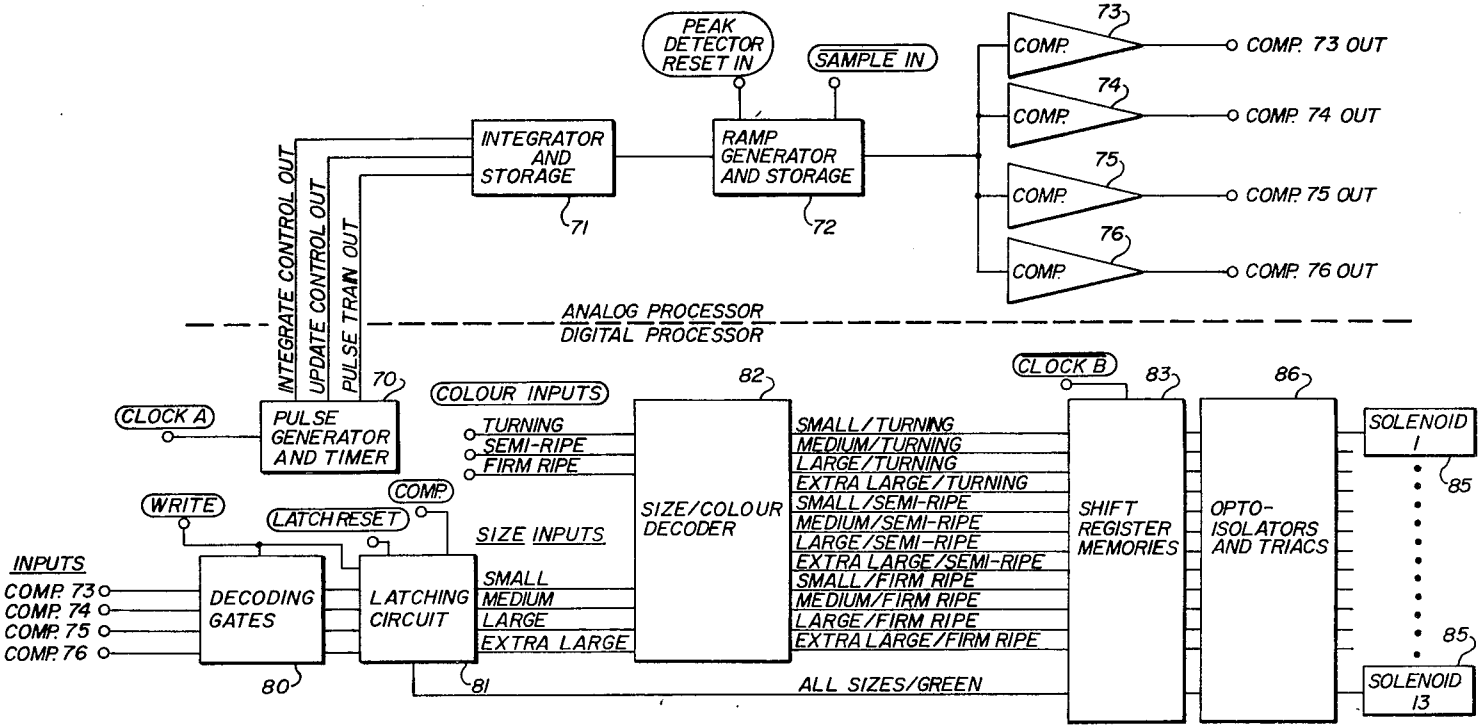
FIG. 3 is a block diagram of a size grader and size/-colour sorter according to the invention.

The size sorting apparatus can be examined by reference to FIG. 3 of the drawings. At a fixed conveyor speed, the $\overline{\text{SAMPLE}}$ pulse width will be proportional to the size of the object, since a large object will be sensed for a longer time than a small object. The duration of the $\overline{\text{SAMPLE}}$ pulse may be converted to a voltage by integrating a constant voltage for the length of the $\overline{\text{SAMPLE}}$ pulse. This is carried out by the ramp generator and storage circuit 72. The output of the ramp generator and storage circuit 72 is a voltage proportional to object size. This voltage is compared to preset limits separating adjacent size categories by four comparators 73–76, which combine to produce a digital code representative of one of five size categories. The $\overline{\text{SAMPLE}}$ pulse width is a function of conveyor speed. The constant voltage to be integrated by the ramp generator 72 must vary according to conveyor speed in order that the output of the ramp generator be independent of conveyor speed.

Referring to FIG. 3, the frequency of CLOCK A (from FIG. 2) is converted to a voltage by a pulse generator and timer 70 and an integrator and storage circuit 71. The pulse generator 70 produces a train of pulses of fixed pulse width in synchronism with the frequency of the CLOCK A pulse train. A timing circuit in block 70 generates an integrator control pulse of fixed duration, approximately 1 second, which allows the integrator 71 to integrater the pulse generator output pulses. Another timing circuit in block 70 generates an update control signal which allows transfer of the integrator output voltage to the analog storage circuit 71 at the end of the integration period. The output voltage of the integrator and storage circuit 71 is the constant voltage determined by the conveyor speed which is integrated by the ramp generator.

The output of the comparators 73–76 of the size sorter are decoded by a series of gates 80, and the size category signal stored by an R/S latch 81. Latch setting is controlled by a 200 microsecond WRITE pulse generated by the timer circuit 41 (FIG. 2) at the trailing edge of the $\overline{\text{SAMPLE}}$ pulse. The outputs of latches 53 (FIG. 2) and 81 are decoded by the size/colour decoder 82 to produce a single digital pulse representing a size/colour category. The signal is stored as a single bit in one of the shift registers of shift register memories 83. Shifting of data in the shift register is controlled by the CLOCK B signal and thus for every 1.5 inches downstream from the sensing head that the object travels, the stored data is advanced one bit in the shift register.

The peak detector (31—FIG. 2) and the ramp generator (72—FIG. 3) are reset by a reset pulse from timer 41 when the object has left the view of the sensing head and the category latches have been set. The R/S latches 53 and 81 are reset by a reset pulse from 53 only after the category information has been stored in the appropriate shift register in 83.

The electromechanical ejection mechanisms (solenoids) are controlled by opto-isolators and triacs 86 operating on standard 110 volt supply. The gates of the triacs are operated by opto-isolators which are controlled by the outputs of the shift registers 83. When a categorized object and its eject station are in juxtaposition, the shift register output changes state for one CLOCK B period or 1.5 inches of conveyor travel, and the ejection mechanism is activated for that same period. The opto-isolators are used to ensure maximum isolation between the small signal digital circuits and the high voltage triacs.

Obviously when sorting on the basis of both colour and size, the opto-isolators and triacs 60 and solenoids 56–58 of FIG. 2 are not needed. Instead the opto-isolators and triacs 86 and solenoids 85 of FIG. 3 are used.

Any colour category signal which is less than the preset voltage of comparator 32 is stored in a separate shift register. For instance, in the case of tomatoes, all sizes of green tomatoes are categorized into one group. Any size category signal less than the preset voltage of comparator 73 inhibits storage of the data in the shift registers and the object is collected at the end of the conveyor. In the case of tomatoes, all colours of tomatoes less than 1.5 inches in diameter are collected at the end of the conveyor.

It will be understood that the present invention, as embodied in a form suitable for sorting tomatoes is but one possible embodiment. Other embodiments, involving a choice of different parameters would be necessary for the sorting of different other objects, and are contemplated by this invention.

What we claim is:

1. Apparatus for sorting objects according to size and colour comprising a conveying means having an overall reflectance in a pair of optical frequency bands less than any of the objects being sorted, sensing means comprising means to illuminate an object on said conveying means, means to receive reflected light from said object, and means to transmit portions of said reflected light to interference filters for isolation of optical signals in said pair of optical frequency bands, colour discriminating means having a means for detecting and converting said signals to electrical signals, means for amplifying said electrical signals, means for determining the ratio of said electrical signals, means for comparing said ratio with preset values to produce a signal representative of a particular colour category, size discriminating means having a voltage integrating means adapted to integrate a voltage proportional to the speed of the conveying means while the object is being sensed, means for comparing said integrated voltage with preset values to produce a signal representative of a particular size category, means for decoding said size and colour category signals to produce a resultant signal representative of a size and colour category, shift register means for storing said resultant signal and advancing said stored signal in accordance with the movement of the conveyer means, and eject means controlled by said shift register means and adapted to eject said object according to the size and colour category.

2. An apparatus as claimed in claim 1 wherein the means for determining the ratio comprises an analog divider and a peak detector adapted to store the peak value of the output of said analog divider.

3. An apparatus as claimed in claim 2 wherein the stored peak value of said output is compared to preset colour limits by a plurality of comparators, said comparators co-operating to produce a digital code output representative of one of the colour categories.

4. An apparatus as claimed in claim 3 wherein said voltage integrating means comprises a ramp generator adapted to integrate the constant voltage determined by the speed of the conveying means and a storage circuit is adapted to store said integrated voltage.

5. An apparatus as claimed in claim 4 wherein said integrated voltage is compared to preset size limits by a plurality of comparators, said comparators co-operating to produce a digital code output representative of one of the size categories.

6. An apparatus as claimed in claim 5 wherein the digital code outputs representative of a size category and a colour category are decoded by a decoder to produce a single digital pulse representative of a size and colour category.

7. An apparatus as claimed in claim 6 wherein said signal digital pulse is stored as a single bit in said shift register means.

8. An apparatus as claimed in claim 7 wherein the stored pulse is advanced on bit in the shift register means for a predetermined amount of movement of the conveyor belt.

9. An apparatus as claimed in claim 8, wherein the eject means comprises electromechanical ejection mechanisms controlled by the shift register means, and adapted to eject the fruit when it is in correspondence with the appropriate mechanism.

10. An apparatus as claimed in claim 9 wherein the objects being sorted are fruit.

11. An apparatus as claimed in claim 10 wherein the conveying means is a conveyor belt.

12. An apparatus as claimed in claim 11 wherein a fibre optic assembly is used to illuminate the fruit, the illuminating means comprising a quartz-iodine lamp, and fibre optic assembly is used to receive and transmit the reflected light.

13. The apparatus as claimed in claim 12 wherein the detecting and converting means comprises a pair of phototransistors.

14. An apparatus for sorting tomatoes according to size and colour comprising a conveying belt having an overall reflectance in a pair of optical frequency bands less than any of the tomatoes being sorted, a fibre optic assembly, to illuminate a tomato, and to receive and transmit in two portions the light reflected from said tomato to interference filters for isolation of said two optical frequency bands, colour discriminating means comprising two phototransistors for detecting and converting said signals to electrical signals $V_{green}$ and $V_{red}$, a summing amplifier adapted to sum the signals detected and converted by said phototransistors, an analog divider for determining the ratio of the two signals such that the ratio, $V_O$, is within defined limits, a peak detector adapted to store the peak value of $V_O$ and a first plurality of comparators for comparing the peak value of $V_O$ with preset values, said comparators co-operating to produce a digital code output representative of one of the colour categories, size discriminating means having a ramp generator adapted to integrate a constant voltage proportional to the speed of the conveying means while the tomato is being sensed and having a storage circuit adapted to store said integrated voltage, a second plurality of comparators for comparing said integrated voltage with preset size limits, said second plurality of comparators co-operating to produce a digital code output representative of one of the size categories, a decoder for decoding the digital code outputs representative of a size category and a colour category to produce a single digital pulse representative of a size and colour category, shift registers for storing said single digital pulse and advancing said stored pulse one bit in the shift register for a predetermined amount of movement of the conveyer belt, and electromechanical ejection mechanisms controlled by the shift registers and adapted to eject the tomato when it is in correspondence with the appropriate mechanism.

15. An apparatus as claimed in claim 14 wherein, $$V_O = 12.5 - 10 \times (V_{green}/V_{red})$$

16. An apparatus as claimed in claim 15 wherein the stored pulse is advanced one bit for each one and one half inches of movement of the conveyor belt.

* * * * *